US007905295B2

(12) United States Patent
Mack

(10) Patent No.: US 7,905,295 B2
(45) Date of Patent: Mar. 15, 2011

(54) ELECTROCOIL TUBING CABLE ANCHOR METHOD

(75) Inventor: John J. Mack, Catoosa, OK (US)

(73) Assignee: Baker Hughes Incorporated, Houston, TX (US)

( * ) Notice: Subject to any disclaimer, the term of this patent is extended or adjusted under 35 U.S.C. 154(b) by 87 days.

(21) Appl. No.: 12/239,086

(22) Filed: Sep. 26, 2008

(65) Prior Publication Data

US 2010/0078179 A1 Apr. 1, 2010

(51) Int. Cl.

| | |
|---|---|
| ***E21B 19/02*** | (2006.01) |
| ***E21B 23/00*** | (2006.01) |
| ***F16L 3/18*** | (2006.01) |
| ***F16L 3/14*** | (2006.01) |

(52) U.S. Cl. ..... 166/385; 166/214; 166/242.2; 138/108; 138/112; 138/114

(58) Field of Classification Search ..... 166/385, 166/242.2, 214; 138/108, 111–114
See application file for complete search history.

(56) References Cited

U.S. PATENT DOCUMENTS

| | | | | |
|---|---|---|---|---|
| 2,035,274 | A * | 3/1936 | Mougey | 174/29 |
| 2,420,712 | A * | 5/1947 | Mample | 174/28 |
| 2,556,244 | A * | 6/1951 | Weston | 174/29 |
| 2,915,089 | A * | 12/1959 | Horsting, Sr. | 138/113 |
| 3,227,800 | A * | 1/1966 | Bondon | 174/29 |
| 3,750,058 | A * | 7/1973 | Bankert et al. | 333/242 |
| 3,758,701 | A * | 9/1973 | Schmidt | 174/28 |
| 5,191,173 | A | 3/1993 | Sizer et al. | |
| 5,262,593 | A * | 11/1993 | Madry et al. | 174/102 R |
| 5,269,377 | A * | 12/1993 | Martin | 166/385 |
| 5,435,351 | A * | 7/1995 | Head | 138/111 |
| 5,742,002 | A * | 4/1998 | Arredondo et al. | 174/29 |
| 5,821,452 | A | 10/1998 | Neuroth et al. | |
| 5,906,242 | A | 5/1999 | Bruewer et al. | |
| 5,954,136 | A | 9/1999 | McHugh et al. | |
| 5,988,286 | A * | 11/1999 | Dwiggins | 166/382 |
| 5,992,468 | A * | 11/1999 | Dwiggins | 138/108 |
| 6,065,540 | A * | 5/2000 | Thomeer et al. | 166/297 |
| 6,143,988 | A | 11/2000 | Neuroth et al. | |
| 6,167,915 | B1 * | 1/2001 | Collie et al. | 138/114 |
| 6,288,339 | B1 | 9/2001 | Efraimsson et al. | |
| 6,323,420 | B1 * | 11/2001 | Head | 174/47 |
| 6,479,752 | B1 * | 11/2002 | Neuroth et al. | 174/106 R |
| 7,670,451 | B2 * | 3/2010 | Head | 156/293 |
| 2005/0045343 | A1 * | 3/2005 | Bixenman et al. | 166/385 |
| 2008/0264651 | A1 * | 10/2008 | Ali et al. | 166/385 |
| 2009/0308618 | A1 * | 12/2009 | Collie | 166/385 |

FOREIGN PATENT DOCUMENTS

| | | | |
|---|---|---|---|
| EP | 893573 | A2 * | 1/1999 |
| GB | 2326536 | A * | 12/1998 |
| WO | WO 9951851 | A1 * | 10/1999 |

* cited by examiner

*Primary Examiner* — Jennifer H Gay
(74) *Attorney, Agent, or Firm* — Bracewell & Giuliani LLP

(57) ABSTRACT

Submersible pump power cable is inserted into a length of tubing. The device comprises an anchoring system attachable to the cable affixed to the tubing inner surface. The anchoring system includes an anchoring sleeve slideable over the cable and insertable into the tubing. Coiling the tubing with the cable and anchoring system inside energizes the sleeve into an anchoring configuration to anchor the cable within the tubing. The anchoring system continues to anchor the cable after uncoiling the tubing and inserting it into a wellbore.

15 Claims, 4 Drawing Sheets

ELECTROCOIL TUBING CABLE ANCHOR METHOD

FIELD OF THE INVENTION

This invention relates in general to supporting a power cable within downhole tubing, and in particular to a method and device enabling installation of an electrical power cable into coiled tubing disposed within a wellbore.

BACKGROUND OF THE INVENTION

Electrical submersible pumps (ESP) are normally installed on the bottom end of jointed production tubing within a cased wellbore and powered by a power cable typically attached to the outside of production tubing. In this configuration, an annulus is formed between the tubing and the wellbore casing and the produced fluids are pumped up the production tubing to the surface.

Oil well completions are being developed to deploy ESPs on the bottom of continuous coiled tubing where the power cable is placed inside the coiled tubing. In these installations, produced fluids are pumped up the annulus between the coiled tubing and the production tubing, or well casing or liner. Many advantages are gained through the use of coiled tubing such as faster deployment, the elimination of a need for large workover rigs, and less frictional pumping losses.

Submersible pump cable has limited yield strength and will break if too long a length of cable is suspended from a support point. Thus when assembling the cable within coiled tubing, the cable is drawn through the coiled tubing on a line while the coiled tubing is horizontally oriented—which is a time consuming effort. Because cable cannot support its total vertical weight, cable support must be provided by the coiled tubing at regular intervals. Various proposals have been made to provide support, such as the use of mechanical anchors. A need exists for anchors which can be used in fairly small diameter coiled tubing, which will accommodate movement associated with thermal expansion and which will accommodate bending of coiled tubing.

SUMMARY OF THE INVENTION

Disclosed herein is a method of assembling a power cable with tubing. The method may include coupling an anchoring system to the power cable where the anchoring system includes an anchoring sleeve that is selectively changeable between an inserting configuration and an anchoring configuration. The power cable with anchoring system is inserting into the tubing and the anchoring sleeve is selectively changed from the inserting configuration into the anchoring configuration. Selectively changing the configuration can be accomplished by coiling the tubing thereby bending the anchoring sleeve and uncoiling the tubing. The anchoring sleeve remains in the anchoring configuration after uncoiling the tubing. The anchoring system can also include anchoring collars that can be secured adjacent at least one end of the anchoring sleeve. In one embodiment the anchoring sleeve is a helical member. Coupling the helical anchoring sleeve involves forming a helical member having a first dimension then radially and elastically compressing the anchoring sleeve from its first diameter to a small diameter anchoring configuration to its tubular inserting configuration and affixing a frangible retaining element to the anchoring sleeve thereby maintaining the anchoring sleeve in its inserting configuration. Bending the anchoring sleeve can break the frangible element and release the anchoring sleeve into its anchoring configuration. The frangible retaining element can be solder applied along the slot as well as a breakable cover provided over at least a portion of the anchoring sleeve. Optionally, the anchoring sleeve can be a tubular member formed from a material having an elastic limit less than the tubing elastic limit so that when bent by coiling the tubing, the sleeve remains bent when the tubing is subsequently straightened. Yet further optionally, the present method includes attaching a rotary pump system to an end of the tubing, connecting a pump motor of the pump system to the power cable, and disposing the pump system with attached tubing and power cable into a wellbore.

The present disclosure also includes a borehole assembly with tubing disposed in the borehole, a length of power cable suspended in the tubing, and an anchoring system joined to the power cable. In one embodiment, the anchoring system includes a sleeve circumscribing a section of the cable and coupled to the inner surface of the tubing and an anchoring collar affixed to the cable, the collar configured for mating engagement with the sleeve. The sleeve is selectively changeable between an inserting and an anchoring configuration. The sleeve may comprise a helical member or a tubular member. The helical member is retainable in its inserting position with a frangible element that is breakable when the member is bent to release the member into engaging position. The tubular member may have an elastic limit less than the tubing elastic limit, thus bending the tubing bends and deforms the member.

DETAILED DESCRIPTION OF THE INVENTION

Figure 1:
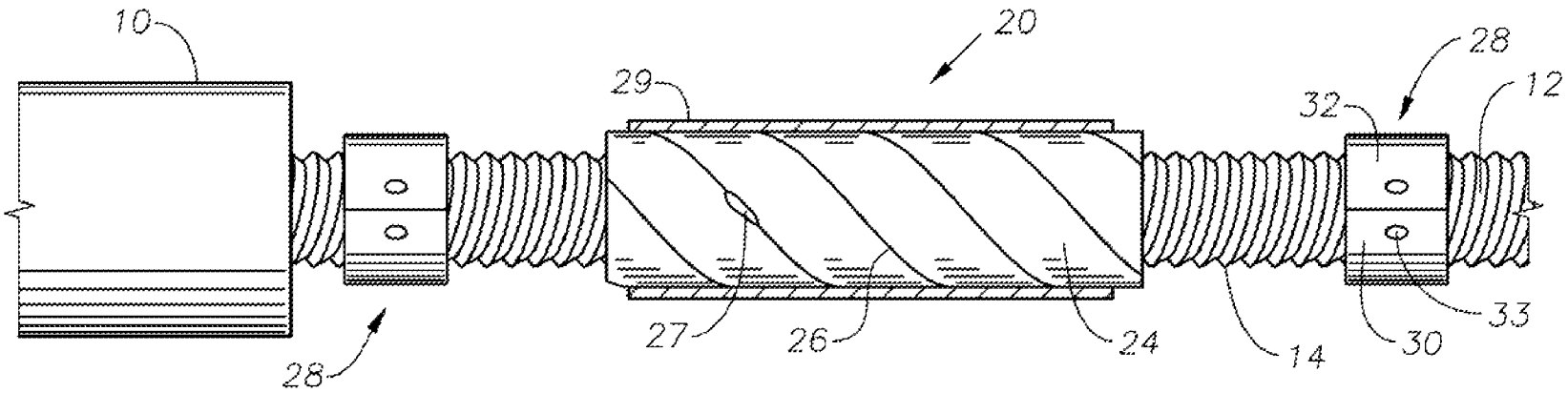
FIG. 1 is a side view of a power cable with an embodiment of an anchoring system being inserted into tubing.

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

One example of an anchoring system 20 combined with a power cable 12 is illustrated in side view in FIG. 1. The anchoring system 20 is depicted in an insertable configuration being slid into coiled tubing 10. In the embodiment of FIG. 1, the anchoring system 20 comprises an annular anchoring sleeve 24 that circumscribes a portion of the power cable 12. The anchoring sleeve 24 comprises a tubular body, preferably of steel, having a helically arranged slot 26 formed along the body to define a helix. Slot 26 extends completely through the wall of the sleeve 24. The slot 26 is cut in the sleeve 24 while it is in natural diameter. Then the sleeve 24 is radially compressed. Shown radially compressed in FIG. 1, the sleeve 24 is insertable into the downhole tubing 10 with the slot 26 defining a line of contact where adjacent portions of the helix are next to one another. The material and slot width are selected so that the deformation from the natural larger diameter to its small diameter of FIG. 1 is not permanent. There is a natural bias tending to cause the sleeve 24 to spring outward to the position of FIG. 2.

The sleeve 24 is expandable both longitudinally and radially into an anchoring configuration. In the anchoring configuration the slot 26*a* defines a gap between the adjacent portions of the helix. The original diameter of the sleeve 24 was greater than in FIG. 2 and the slots 26 had greater widths. When allowed to spring outward, preferably a spring force exists in sleeve 24, causing it to grip the tubing 10 inner diameter. The sleeve 24 may be retained in the insertable configuration of FIG. 1 by a frangible element. Examples of a frangible element include solder 27 applied along at least a portion of the slot 26 and optionally a breakable cover 29 circumscribing at least a portion of the anchoring sleeve 24. Optionally, the cover 29 may circumscribe the entire length of the anchoring sleeve 24. The sleeve 24 will expand outward due to its own resilience after the solder 27 or cover 29 is broken.

Also on the cable 12 are anchoring collars 28 provided on either end of the sleeve 24. The collars 28 comprise collar halves 30, 32 having a semicircular cross-section and joined along their respective ends with each other. Each collar half 30, 32 includes a threaded aperture 33 registerable with a corresponding threaded aperture 33 when placing the halves 30, 32 over the cable 12. Screw bolts or other fasteners may be inserted through the threaded aperture thereby securing the halves 30, 32 together on the cable 12. Collars 28 are preferably spaced apart from each other a greater length than the length of the sleeve 24 when expanded. The anchoring collars 28 may have an inner circumference shaped to match the undulations 14 running along the cable 12 outer surface.

Figure 2:
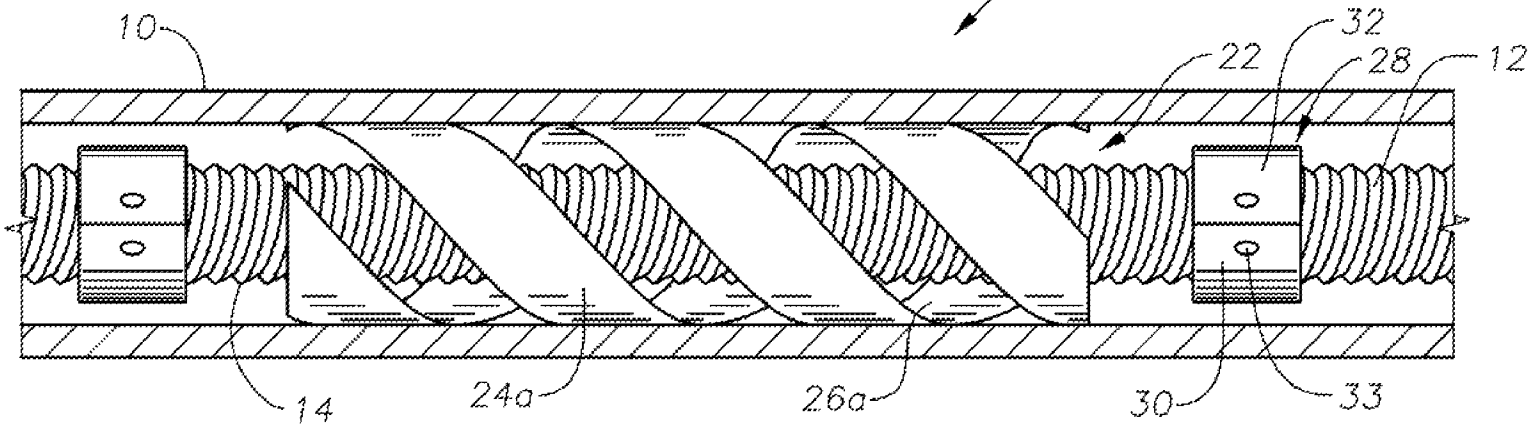
FIG. 2 is a side view of the power cable with the anchoring system of FIG. 1 in tubing, the anchoring system in an anchoring configuration.

Shown in a partial sectional view in FIG. 2, the cable 12 with anchoring system 20 is disposed within a portion of the tubing 10, and the anchoring sleeve 24*a* has been selectively changed into an anchoring configuration 22. In this configuration, the body of the sleeve 24*a* is radially and longitudinally expanded that correspondingly expands the slot 26*a* width. In the anchoring configuration, the sleeve 24*a* has an outer circumference that elastically expands into engagement with the tubing 10 inner circumference thereby affixing the sleeve 24*a* at that location in the tubing 10. The collars 28 will engage the respective ends of the sleeve 24*a*, thereby limiting cable 12 travel within the tubing 10. In one example of assembly, the anchoring sleeves 24. 24*a* of FIGS. 1 and 3 may be slid on an end of the cable 12 before the cable 12 is slid into the tubing 10.

The sleeve 24*a* of FIG. 2 is shown in a more relaxed or lower potential energy state than the configuration of the sleeve 24 of FIG. 1. Changing the sleeve 24*a* into the insertable configuration shown in FIG. 1 requires radially and longitudinally compressing the sleeve 24 thereby storing potential energy in the sleeve 24. Generally a length of tubing 10 is uncoiled from a tubing spool and laid horizontally on a surface before inserting the cable 12. The tubing 10 is then coiled back onto the reel. Fracturing or removing the frangible elements, i.e., the solder 27, the breakable cover 29, or some other element, removes the retaining means associated with the sleeve 24, thereby allowing the sleeve to expand to its anchoring state shown in FIG. 2. Coiling the tubing 10 onto a reel bends the sleeve and fractures frangible element that allows the sleeve 24 to expand to its lower energy state and engage the tubing 10 inner circumference. Due to the inherent internal stresses within the sleeve 24, a subsequent uncoiling or straightening of the tubing 10 will not return the sleeve 24 to the insertable configuration. Instead the system 20 remains in the anchoring configuration to retain the cable 12 within the tubing 10.

Figure 3:
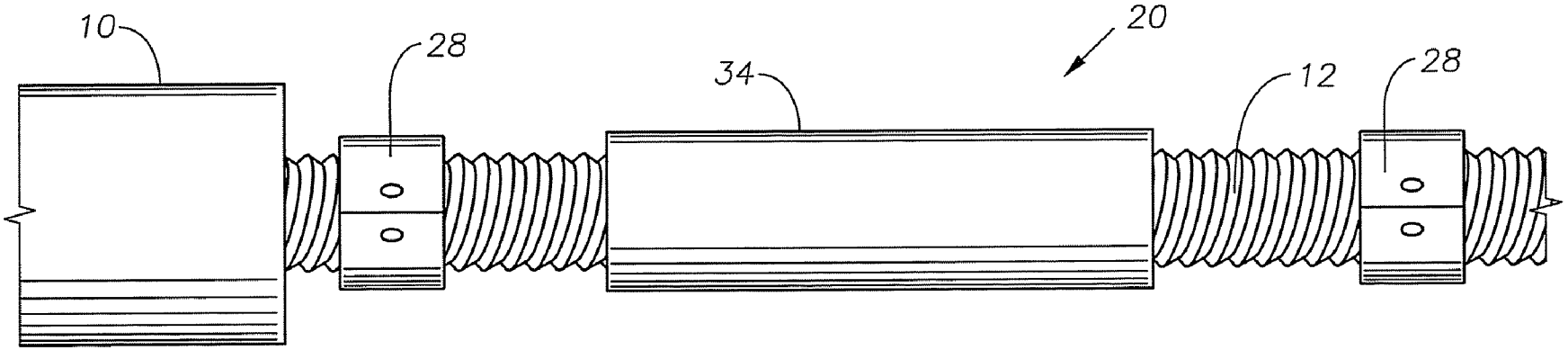
FIG. 3 is a side view of a power cable with an additional embodiment of an anchoring system being inserted into tubing.

Shown in side view in FIG. 3 is an alternative anchoring sleeve 34 that comprises a portion of an anchoring system 20b. In this embodiment, the anchoring sleeve 34 is a substantially tubular member circumscribing a cable 12 and between a pair of anchoring collars 28 spaced apart a greater length than the anchoring sleeve 34. The cable 12 with sleeve 34 is shown being inserted into tubing 10. The anchoring sleeve 34 of this embodiment preferably comprises a material whose elastic limit is less than the tubing 10 elastic limit. Examples of such material include aluminum, copper, brass, bronze, and alloys thereof. The tubing 10 may comprise steel. The anchoring sleeve 34 is also changeable from its insertable configuration of FIG. 3 into an anchoring configuration of FIG. 5.

Figure 5:
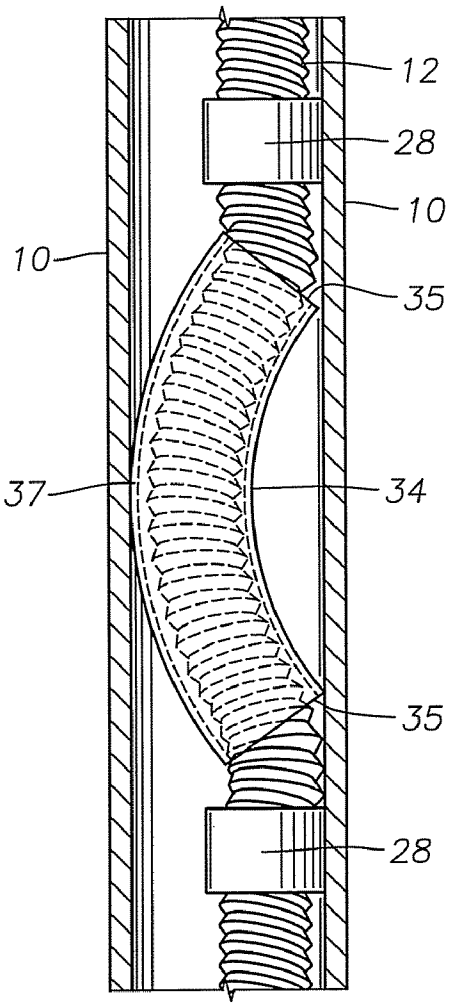
FIG. 5 is a side view of the power cable with the anchoring system of FIG. 3 in tubing, the anchoring system in an anchoring configuration.
Figure 4:
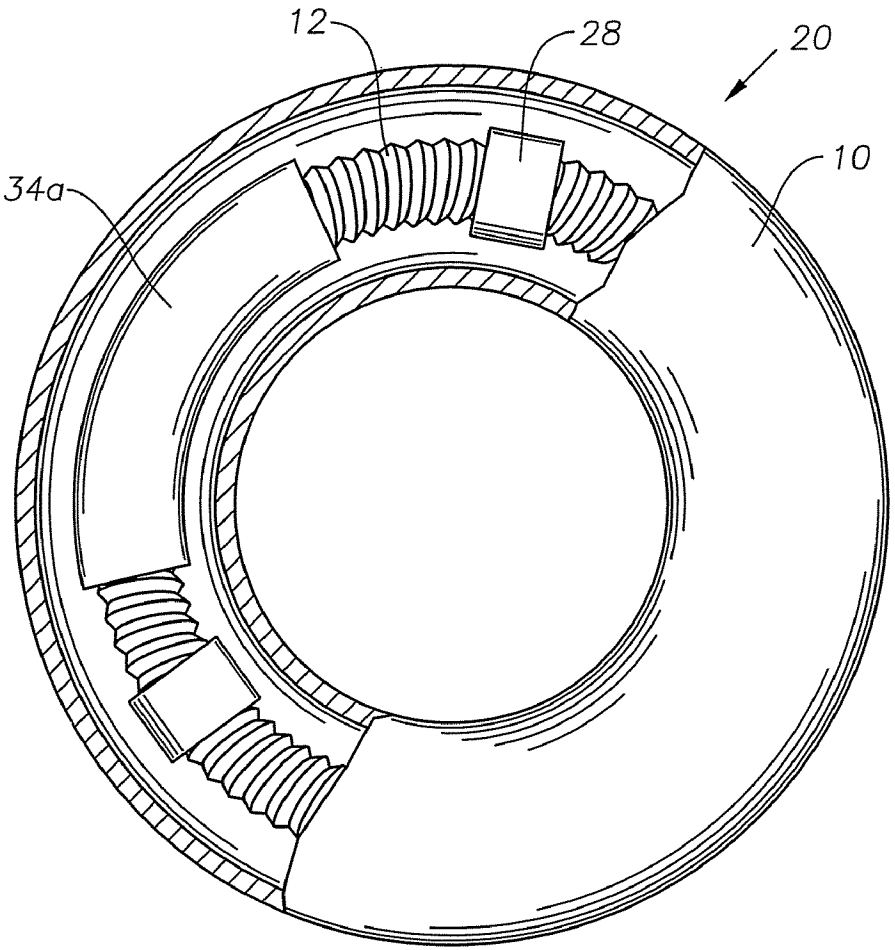
FIG. 4 is a side partial sectional view showing the tubing with cable therein of FIG. 3 in a coiled arrangement with inserted power cable.

With reference now to FIG. 4, a side partially sectional view of tubing 10 formed into a coil is shown with the cable 12 and anchoring system 20. The anchoring sleeve 34 should be sufficiently elongated so coiling the tubing 10 creates a bent anchoring sleeve 34*a*. The anchoring sleeve 34 is plastically deformed due to the coiling force and remains in the bent position. Tubing 10 does not plastically deform when coiled onto a reel. As shown in a partial sectional view in FIG. 5, the bent anchoring sleeve 34*a* is plastically deformed and has its ends 35 engaging the tubing 10 inner circumference along an azimuth of the tubing 10. When the tubing 10 is again straightened for insertion into a well, the sleeve 34*a* remains bent. The bent or deformed sleeve 34*a* has its midsection 37 engaging the tubing 10 inner circumference at a location approximately 180 degrees from the azimuth of contact between the sleeve ends 35. Accordingly, sufficient plastic deformation of the sleeve 34 effectively wedges the bent sleeve 34*a* within the tubing 10 at a particular location within the tubing 10. Clearance between the bent sleeve 34*a* outer diameter and tubing 10 inner diameter allows the tubing 10 to be uncoiled and straightened without fully straightening the bent sleeve 34*a*. Although the tubing 10 will unbend the bent sleeve 34*a* somewhat. As seen in FIG. 5 however, the bent sleeve 34*a* will not fully respond to tubing 10 deformation due to the clearance between the tubing 10 and sleeve 34*a* inner and outer respective dimensions. The added anchor collars 28 are configured for mating engagement with the ends 35 to thereby anchor the cable 12 with respect to the sleeve 34*a*.

Figure 6:
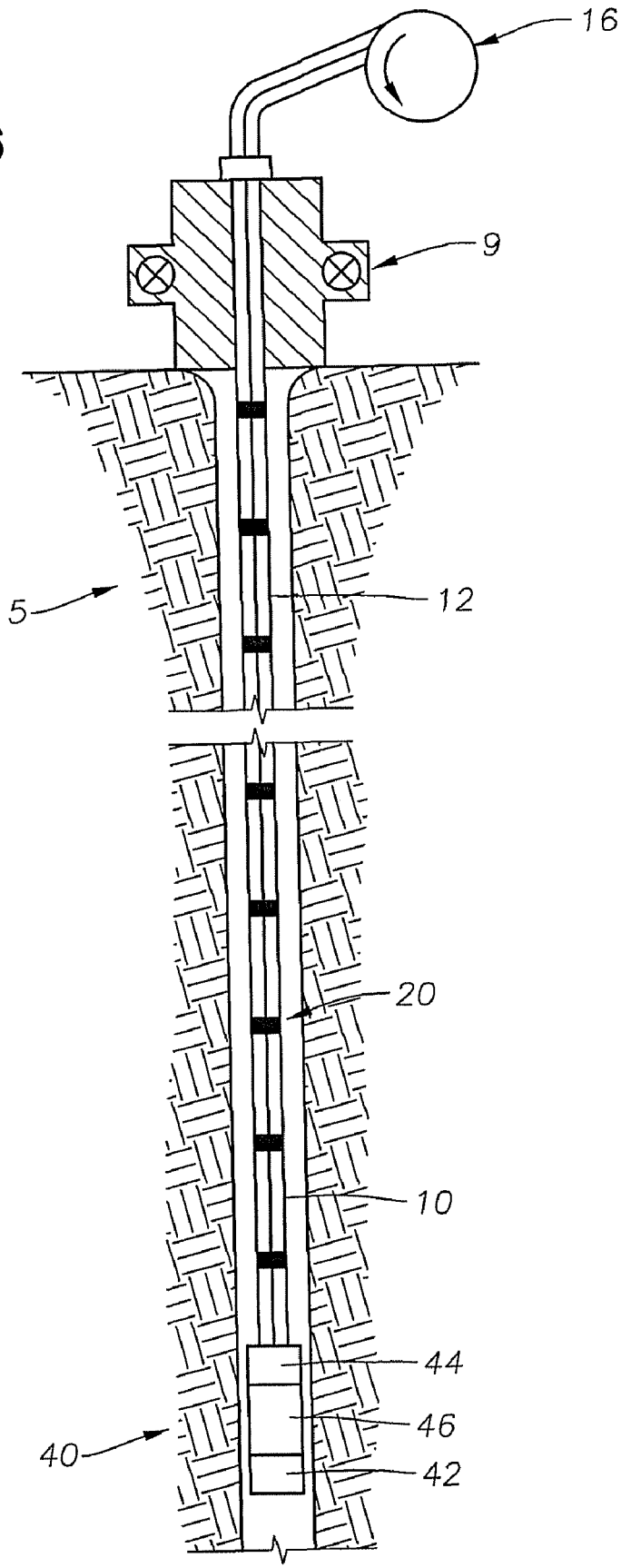
FIG. 6 is a side partial sectional view of an embodiment of a cable anchoring system in accordance with the present disclosure disposed in a wellbore.

FIG. 6 depicts is partial sectional side view an embodiment of the anchoring system described herein for use in a wellbore. Borehole tubing 10 is illustrated being uncoiled from a tubing reel 16 and inserted into a borehole 5 through a wellhead housing 9. Power cable 12 is supported within the tubing 10 on multiple anchoring systems 20. The anchoring systems have been energized by coiling the tubing after the cable 12 was inserted into the tubing 10 while horizontal. The anchoring systems retain the cable 12 within the tubing 10 after subsequent uncoiling of the tubing 10 to thereby anchor the cable 12 in the tubing. As is known, downhole cable can break under its own weight; therefore the distance between adjacent anchoring systems 20 is dictated by the cable strength and density.

An electrical submersible pumping (ESP) system 40 is illustrated attached to the lower terminal end of the tubing 12. In this embodiment, the ESP system 40 comprises a pump motor 42, a pump 44, and an equalizer or seal section 46 between the pump 44 and motor 42. The power cable 12 is shown attached to the pump motor 42 for providing electrical power to the pump motor 42 for running the pump 44.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. While the invention has been shown in only two of its forms, it should be apparent to those skilled in the art that it is not so limited but is susceptible to various changes without departing from the scope of the invention.

The invention claimed is:

1. A method of assembling power cable with tubing, the method comprising:

a. providing an anchoring system comprising an annular anchoring sleeve;

b. inserting the power cable into the anchoring sleeve;

c. inserting the power cable with the anchoring sleeve into the tubing;

d. coiling the tubing so that the anchoring sleeve bends within the coiled tubing and engages an inner circumference of the tubing; and e. uncoiling the tubing, wherein the anchoring sleeve remains engaged with the inner circumference of the tubing in an anchoring configuration that anchors the power cable in the tubing.

2. The method of claim 1 wherein the anchoring system further comprises anchoring collars, the method further comprising securing collars adjacent at least one end of the anchoring sleeve.

3. The method of claim 1, wherein in steps (a)-(c) the anchoring sleeve comprises a helical member that is axially compressed so that the adjacent portions of the helical member are held in contact with a frangible element and bending the anchoring sleeve breaks the frangible element so that the helical member expands in step (d) to engage the inner circumference of the tubing.

4. The method of claim 3, wherein the frangible element is selected from the list consisting of solder applied along the slot and a breakable cover provided over at least a portion of the anchormg sleeve.

5. The method of claim 1 wherein the anchoring sleeve comprises a tubular member formed from a material whose elastic limit is less than the tubing elastic limit so that when bent by coiling the tubing. the sleeve remains bent when the tubing is subsequently straightened.

6. The method of claim 5, wherein a clearance is between the sleeve outer diameter and tubing inner diameter.

7. The method of claim 1 further comprising attaching a rotary pump system to an end of the tubing, connecting a pump motor of the pump system to the power cable, and disposing the pump system with attached tubing and power cable into a wellbore.

8. The method of claim 1, further comprising coupling a plurality of the anchoring systems to the power cable.

9. A method of assembling power cable with tubing comprising:

providing an anchoring system comprising: it helical anchoring sleeve that forms a helix and is axially compressed so that adjacent portions of the helix are in contact, and a frangible element coupled with the anchoring sleeve to retain the anchoring sleeve in the axially compressed configuration;

inserting the power cable into the anchoring sleeve;

inserting the power cable with anchoring sleeve into the tubing;

fracturing the frangible element by coiling the tubing so that the helical sleeve radially and axially expands into anchoring engagement between the power cable and an inner surface of the tubing; and uncoiling the borehole tubing, wherein the anchoring sleeve remains in anchoring engagement between the power cable and the tubing.

10. The method of claim 9 further comprising forming the anchoring sleeve by providing a tubular formed from an elastic material and having an outer diameter greater than the tubing inner diameer, forming a slot through the tubular wall along a helical path to form the helically shaped anchoring sleeve.

11. A borehole assembly comprising:

tubing disposed in the borehole;

a length of power cable suspended in the tubing;

an anchoring sleeve circumscribing a section of the power cable and that is changeable from an insertion configuration slideable with respect to the power cable and freely slideable inside of the tubing to an anchoring configuration coupled to an inner surface of the tubing; and a frangible element circumscribing the anchoring sleeve and retaining the anchoring sleeve in the insertion configuration, wherein when in the anchoring configuration the anchoring sleeve comprises an annular body having a slot formed along a helical path therethrough to define a helical member and the annular body outer circumference resiliently engages the tubing inner circumference.

12. The borehole assembly of claim 11, wherein when in the inserting configuration, the anchoring sleeve is radially and resiliently under compression so as to have an outer circumference smaller than the tubing inner circumference.

13. The borehole assembly of claim 11, wherein the frangible element fractures when the tubing is coiled thereby enabling the anchoring sleeve to expand into the anchoring configuration, and wherein the frangible element is selected from the list consisting of solder applied along the slot and a breakable cover provided over at least a portion of the anchoring sleeve.

14. The borehole assembly of claim 11, wherein the anchoring sleeve comprises a tubular member formed from a material whose elastic limit is less than the tubing elastic limit, so that coiling the tubing then installing the tubing in the borehole, plastically bends the tubular member.

15. The borehole assembly of claim 11, further comprising a rotary pump connected to the tubing end.

* * * * *